US007714246B2

(12) United States Patent
Lin

(10) Patent No.: US 7,714,246 B2
(45) Date of Patent: May 11, 2010

(54) KEY BUTTON, KEY ASSEMBLY USING THE KEY BUTTON AND PORTABLE ELECTRONIC DEVICE USING THE KEYPAD ASSEMBLY

(75) Inventor: Yu-Yuan Lin, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 203 days.

(21) Appl. No.: 11/964,828

(22) Filed: Dec. 27, 2007

(65) Prior Publication Data

US 2009/0095613 A1 Apr. 16, 2009

(30) Foreign Application Priority Data

Oct. 15, 2007 (CN) ..... 2007 1 0202062

(51) Int. Cl.
*H01H 1/36* (2006.01)

(52) U.S. Cl. ..... 200/536; 200/341

(58) Field of Classification Search ..... 200/310–315, 200/341–345, 512–520, 536, 406
See application file for complete search history.

(56) References Cited

U.S. PATENT DOCUMENTS

| | | | | |
|---|---|---|---|---|
| 6,605,786 | B2 * | 8/2003 | Juret et al. | 200/4 |
| 2007/0235294 | A1 * | 10/2007 | Kang | 200/4 |
| 2007/0249186 | A1 * | 10/2007 | Ju | 439/71 |
| 2008/0080187 | A1 * | 4/2008 | Purinton | 362/294 |

* cited by examiner

*Primary Examiner*—Renee S Luebke
*Assistant Examiner*—Lisa Klaus
(74) *Attorney, Agent, or Firm*—Steven M. Reiss

(57) ABSTRACT

A portable electronic device (10) is provided. The portable electronic device includes the keypad assembly (20). The keypad assembly includes key buttons (30 or 60). Each key button includes a key portion (32 or 62), a supporting portion (34 or 66), a switching portion (35 or 64), a pad portion (36 or 67), and a circuit board portion (38 or 68). The supporting portion defines a first through hole (344 or 664). The switching portion includes at least one switching elastic sheet (354 or 644). The pad portion includes a base body (362 or 672) and a protruding portion (364 or 674). The circuit board portion includes a first contacting point (3821 or 6821), a contacting sheet (384 or 684), and at least one second contacting point (3822 or 6822).

13 Claims, 5 Drawing Sheets

KEY BUTTON, KEY ASSEMBLY USING THE KEY BUTTON AND PORTABLE ELECTRONIC DEVICE USING THE KEYPAD ASSEMBLY

BACKGROUND OF THE INVENTION

1. Field of the Invention

The present invention relates to input devices, particularly to a key button, a keypad assembly using the key button, and a portable electronic device using the keypad assembly.

2. Description of Related Art

Keypad assembly is inevitably used in a portable electronic device, such as a mobile phone, for inputting information into the device, such as control commands.

A typical keypad assembly often includes at least one key button therewith. A user can input information into the device simply by operating/pressing the at least one key button. Unfortunately, the user may make mistakes during operation, such as pressing the wrong key button. When this happens, additional operation is needed by the user to amend/correct such mistakes.

Therefore, a heretofore-unaddressed need exists in the art to address the aforementioned deficiencies and inadequacies.

SUMMARY

In first aspect thereof, a key button is provided. The key button includes a key portion, a supporting portion, a switching portion, a pad portion, and a circuit board portion. The supporting portion has a first through hole defined therethrough. The switching portion includes at least one switching elastic sheet. The pad portion includes a base body and a protruding portion. The protruding portion is formed on the base body. The circuit board portion includes a first contacting point, a contacting sheet, and at least one second contacting point. The pad portion is located between the supporting portion and the circuit board portion with the protruding portion configured for engaging through the first through hole of the supporting portion to attach with the key portion. As the key portion is pressed towards the circuit board portion, the switching portion moves along with the pad portion so as to firstly electronically connect the contacting sheet with the at least one second contacting point via the respective switching elastic sheet. Secondly, as the key portion is further pressed, the contacting sheet further electronically connects with the first contacting point.

In second aspect thereof, a keypad assembly is provided. The keypad assembly includes at least one present key button.

In third aspect thereof, a portable electronic device is provided. The portable electronic device includes the present keypad assembly.

These and other aspects of the present invention will become more apparent from the following detailed description of the preferred embodiments taken in conjunction with the accompanying drawings, although variations and modifications therein may be affected without departing from the spirit and scope of the novel concepts of the disclosure.

BRIEF DESCRIPTION OF THE DRAWINGS

Many aspects of the present key button, the keypad assembly using the key button, and the portable electronic device using the keypad assembly can be better understood with reference to the following drawings. These drawings are not necessarily drawn to scale, the emphasis instead being placed upon clearly illustrating the principles of the present key button, the keypad assembly, and the portable electronic device. Moreover, in the drawings like reference numerals designate corresponding parts throughout the several views. Wherever possible, the same reference numbers are used throughout the drawings to refer to the same or like elements of an embodiment.

DETAILED DESCRIPTION OF THE EMBODIMENTS

The present key button and keypad assembly using at least one key button are described here in conjunction with the accompanying drawings in FIGS. 1 through 5. The keypad assembly is suitably assembled in a portable electronic device, such as the mobile phone, the personal digital handset, or the like.

Figure 1:
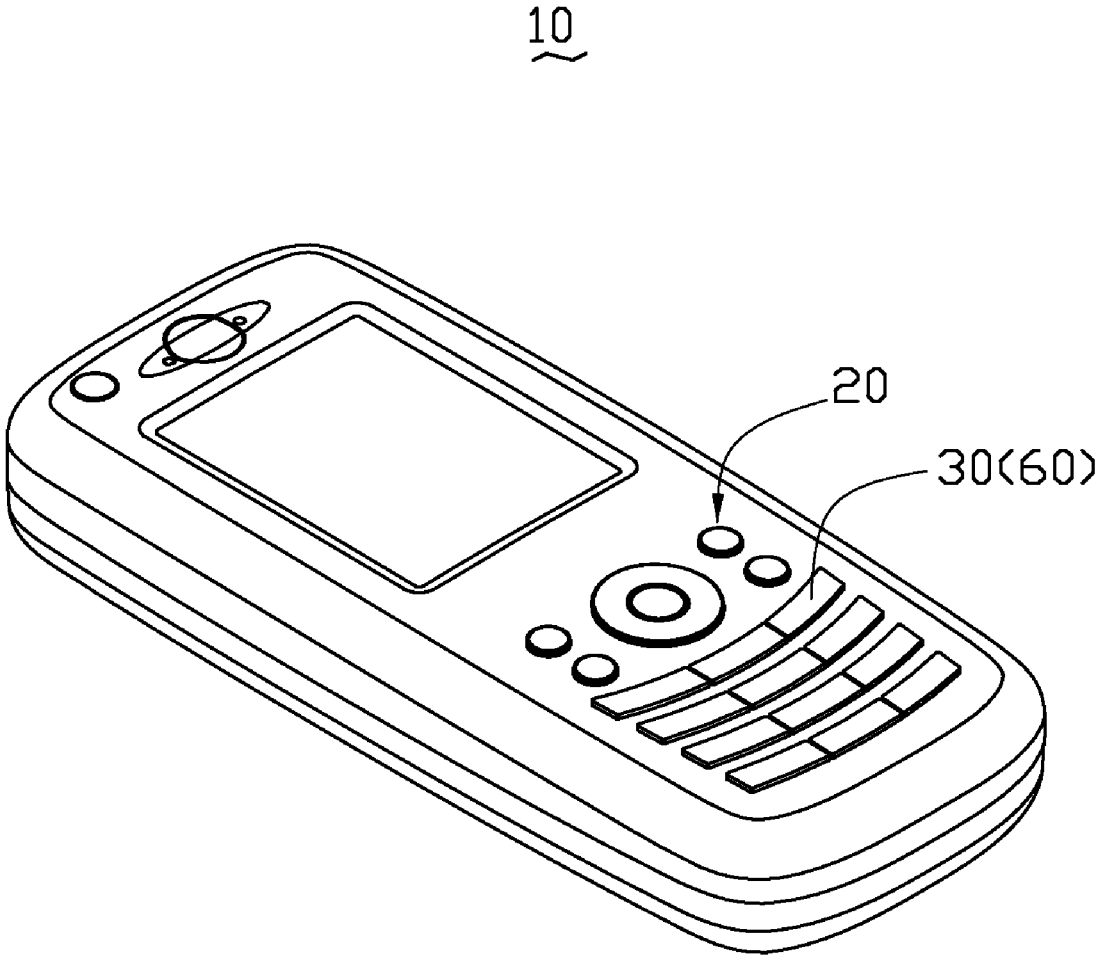
FIG. 1 is an isometric view of a portable electronic device using a keypad assembly in accordance with a first and second embodiment, the keypad assembly including at least one key button.

Referring to FIG. 1, the keypad assembly 20 incorporated within the portable electronic device 10 includes at least one key button 30. The at least one key button 30 is arranged and distributed on a surface of the keypad assembly 20 in a certain pattern.

Figure 2:
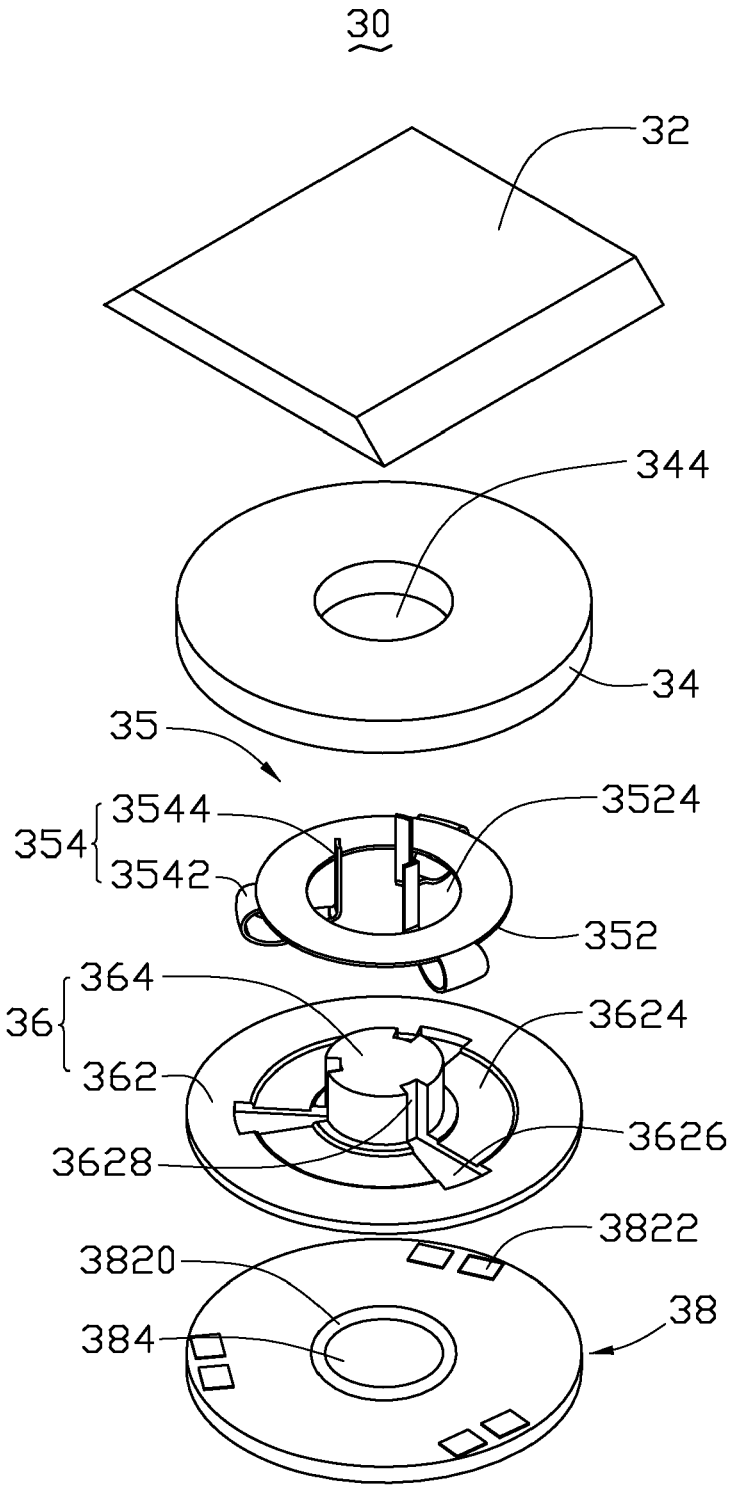
FIG. 2 is an exploded view of one key button shown in FIG. 1 in accordance with the first embodiment.

Referring to FIG. 2, the at least one key button 30 of the first embodiment each includes a key portion 32, a supporting portion 34, a switching portion 35, a pad portion 36, and a circuit board portion 38.

The key portion 32 is generally rectangular and advantageously has at least one symbol (e.g., number) labeled therewith.

The supporting portion 34 is configured for supporting the key button 30 within the keypad assembly 20 and holding the key button 30 in place with the keypad assembly 20. The supporting portion 34 is advantageously disc-shaped and formed on a housing of the portable electronic device 10. The supporting portion 34 has a first through hole 344 defined therethrough.

The switching portion 35 includes a main body 352 and three switching elastic sheets 354. The three switching elastic sheets 354 are formed on a same side of the main body 352 and spaced evenly with one another. The main body 352 is a circular-shaped sheet with a second through hole 3524 defined therethrough. The diametrical size of the second through hole 3524 is bigger than that of the first through hole 344 of the supporting portion 34.

Each of the three switching elastic sheets 354 includes a curve portion 3542 and a straight portion 3544. The curve portion 3542 is bent with a semi-circular shape and extends from an exterior side of the main body 352. The curve portion 3542 is configured to be pressed towards the main body 352 with its original semi-circular shape deformed. The straight portion 3544 extends from the curve portion 3542 through the second through hole 3524 of the main body 352.

The pad portion 36 includes a base body 362 and a protruding portion 364. The protruding portion 364 is formed on the base body 362. The base body 362 has an accommodating groove 3624 defined therein and three through apertures 3626 defined therethrough. The accommodating groove 3624 is defined corresponding to the main body 352 of the switching portion 35 and configured for accommodating the main body 352 therein. The three through apertures 3626 are defined corresponding to the respective curve portion 3542 and configured for facilitating the three switching elastic sheets 354 engaging through the base body 362 with the three curve portions 3542 respectively engaging through the three through apertures 3626.

The protruding portion 364 is generally cylindrical and has substantially the same size and shape as that of the first through hole 344 of the supporting portion 34. The protruding portion 364 has three receiving grooves 3628 defined through a surrounding wall thereof corresponding to the three straight portion 3544s, respectively. The three receiving grooves 3628 respectively communicate with the three through apertures 3626 of the pad portion 36 and configured for receiving the corresponding straight portion 3544 therein as the three switching elastic sheets 354 engaging through the base body 362.

The circuit board portion 38 includes a welding pad 3820, a first contacting point 3821, a contacting sheet 384, and three second contacting points 3822. The welding pad 3820 is advantageously annular-like and disposed on and electronically connects with the circuit board portion 38. The contacting sheet 384 is attached to the circuit board portion 38 via soldering with the welding pad 3820. The contacting sheet 384 thus indirectly electronically connects with the circuit board portion 38 via connecting with the welding pad 3820.

The first contacting point 3821 is disposed on and electronically connects with the circuit board portion 38. Furthermore, the first contacting point 3821 is located within a space enclosed by the contacting sheet 384 and the circuit board portion 38. The three second contacting points 3822 are disposed on and electronically connect with the circuit board portion 38 corresponding to the three through apertures 3626 of the pad portion 36. Advantageously, the three second contacting points 3822 are evenly arranged around the contacting sheet 384 and the first contacting point 3821.

Figure 3:
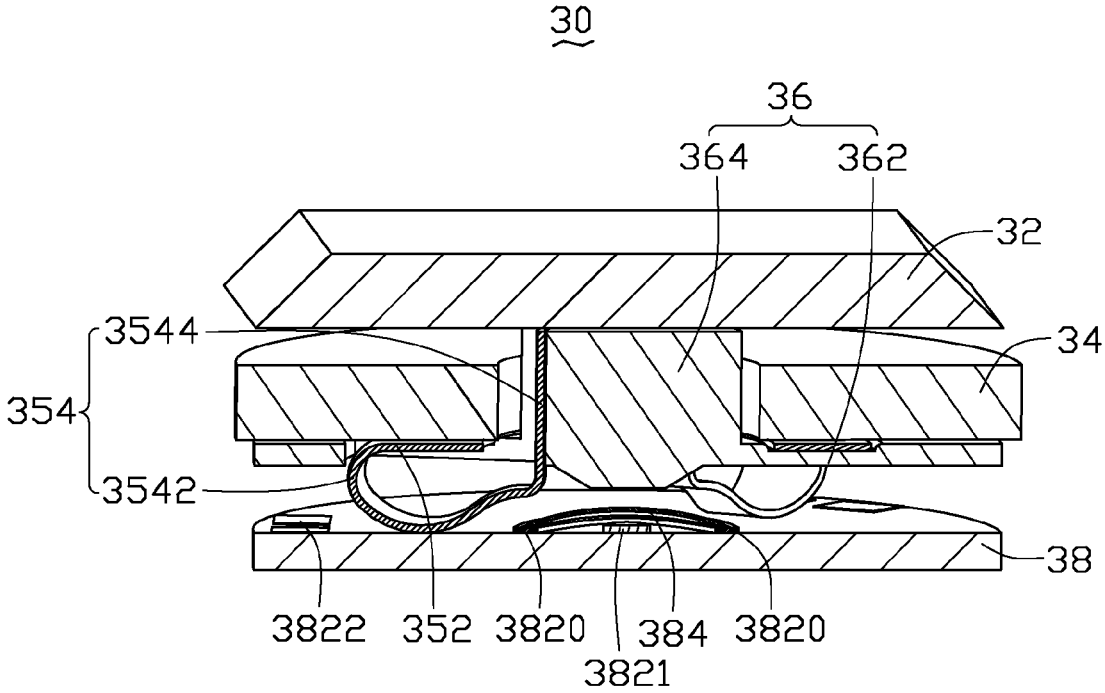
FIG. 3 is a partially cut-away view of an assembled key button in accordance with the first embodiment.

Referring to FIG. 3, during assembly, the switching portion 35 is mounted into the pad portion 36. As such, the main body 352 of switching portion 35 is inserted and accommodated into the accommodating groove 3624 of the base body 362 of the pad portion 36. The straight portion 3544 of each switching elastic sheet 354 is received in the corresponding receiving groove 3628. The curve portion 3542 of each switching elastic sheet 354 is inserted and engages through the corresponding through aperture 3626.

After that, the pad portion 36 combined with the switching portion 35 is inserted through the first through hole 344 of the supporting portion 34 and then attached with the key portion 32. During this stage, the protruding portion 364 of the pad portion 36 engages through the first through hole 344 to attach (e.g. adhere) with the key portion 32. In this case, the supporting portion 34 is located between the key portion 32 and the main body 352 of the switching portion 35. The key portion 32 has a lower wall facing the supporting portion 34 to resist against the curve portions 3542 received in the receiving grooves 3628. The curve portions 3542 thus are retained in the receiving grooves 3628, respectively.

As assembled, the circuit board portion 38 is located below the pad portion 36. Thus, the pad portion 36 is located between the supporting portion 34 and the circuit board portion 38. The curve portions 3542 of the switching elastic sheets 354 are located between the pad portion 36 and the circuit board portion 38. As shown in FIG. 3, the curve portions 3542 each contact with an exterior surface of the circuit board portion 38 in its original state without being biased. The curve portions 3542 can instead be biased between the exterior surface of the circuit board and the pad portion 36. The curve portions 3542 can also be spaced with least distance from the exterior surface of the circuit board portion 38 with a certain space without any contact.

In use, as the key portion 32 is pressed towards the circuit board portion 38, the switching portion 35 moves along with the pad portion 36 and the key portion 32. The curve portion 3542 of each switching elastic sheet 354 is biased between the circuit board portion 38 and the pad portion 36. During biasing of the curve portion 3542, the curve portion 3542 extends in a longitudinal direction along the exterior surface of the curve portion 3542.

As the curve portion 3542 extends and reaches the corresponding second contacting point 3822, the contacting sheet 384 electronically connects with the second contacting point 3822 via the switching elastic sheet 354. In this case, the information corresponding to the pressed key portion 32 is inputted into the portable electronic device 10 and advantageously shown in an user interface (not labeled), such as a display window of the portable electronic device 10. The displayed information is temporary and can disappear from the user interface simply by releasing the key portion 32 of the key button 30.

To make the displayed information valid in the user interface, the key portion 32 needs to be further pressed. During further pressing, the curve portions 3542 extend longitudinally and maintain the electronic connection of the contacting sheet 384 and the second contacting points 3822. As such, the protruding portion 364 of the pad portion 36 further moves towards the contacting sheet 384.

As the protruding portion 364 reaches the contacting sheet 384 to an extent that the contacting sheet 384 is deformed by the protruding portion 364 to contact the first contacting point 3821, the first contacting point 3821 electronically connects with the contacting sheet 384. Thus, the first contacting point 3821, the contacting sheet 384, and the second contacting point are electronically connected in the order written. Even if the key portion 32 of the key button 30 is released, the displayed information is maintained valid on the user interface.

Figure 4:
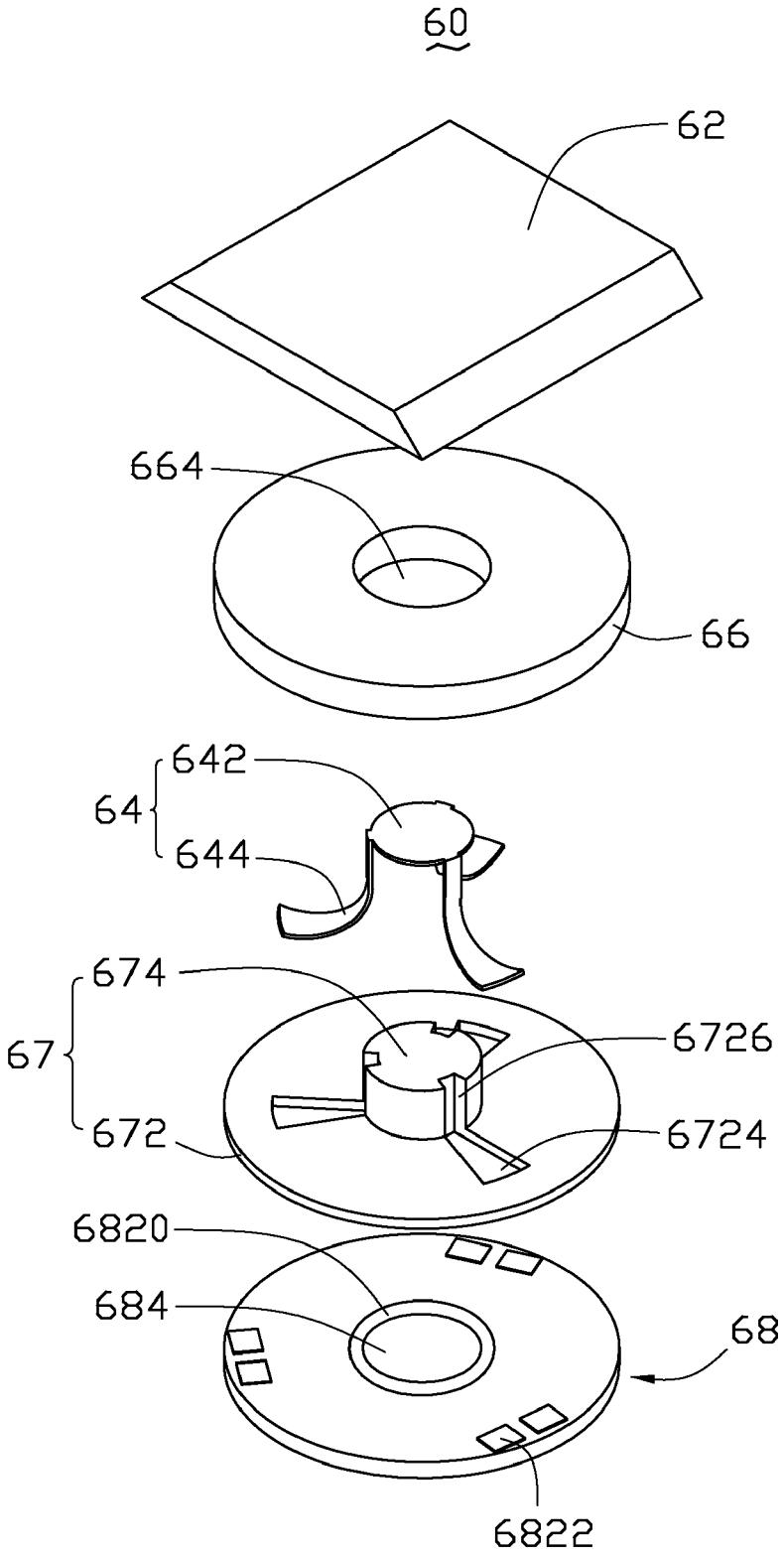
FIG. 4 is an exploded view of one key button shown in FIG. 1 in accordance with the second embodiment.
Figure 5:
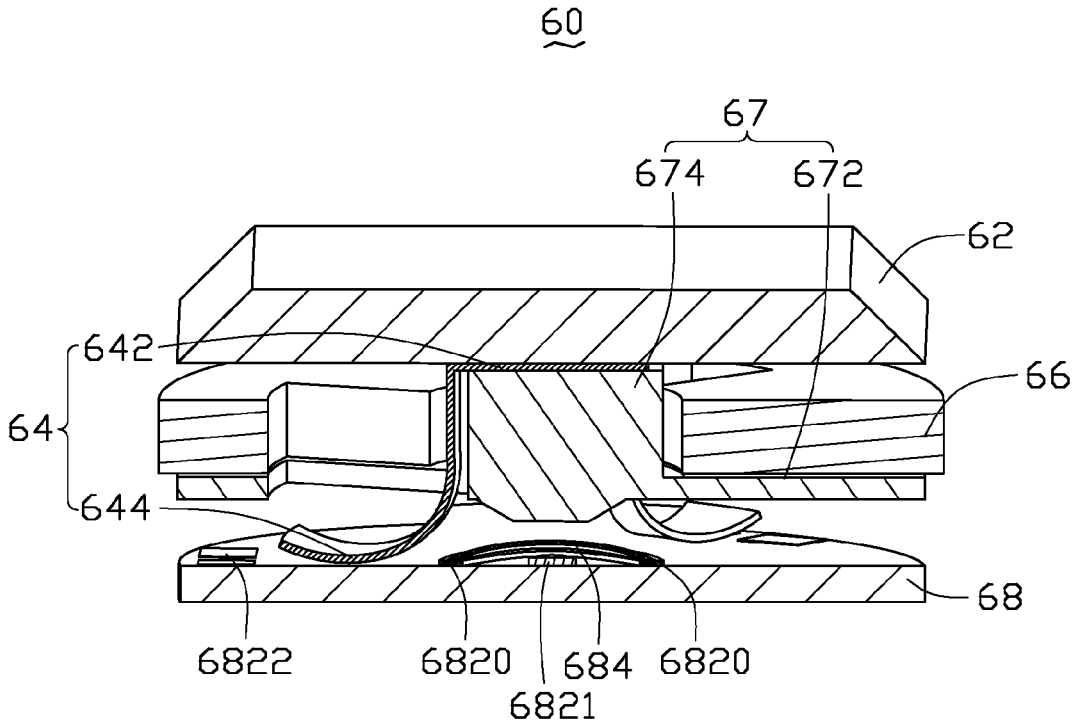
FIG. 5 is a partially cut-away view of an assembled key button in accordance with the second embodiment.

Alternatively, referring to FIGS. 4 and 5, the key button 60 of the second embodiment includes a key portion 62, a supporting portion 66, a switching portion 64, a pad portion 67, and a circuit board portion 68. The key portion 62, the supporting portion 66, and the circuit board portion 68 are substantially the same as those of the first embodiment of the key button 30. The supporting portion 66 includes a first through hole 664 defined therethrough. The circuit board portion 68 includes a welding pad 6820, a first contacting point 6821, a contacting sheet 684, and three second contacting points 6822. Main differences between the first embodiment and second embodiment are reflected on the switching portion 64 or 35 and the pad portion 67 or 36.

The switching portion 64 includes a main body 642 and three switching elastic sheets 644. The main body 642 is a circular-shaped sheet. The three switching elastic sheets 644 are formed on a same side of the main body 642 and spaced evenly with one another. Each of the three switching elastic sheets 644 is J-shaped.

The pad portion 67 has a roughly same structure as that of the pad portion 36 of first embodiment. The pad portion 67 includes a base body 672 and a protruding portion 674. The base body 672 has three through apertures 6724 defined therethrough corresponding to the three switching elastic sheets 644. The three through apertures 6724 are configured for facilitating the three switching elastic sheets 644 partially engaging through the three through apertures 6724.

The protruding portion 674 has three receiving grooves 6726 defined therethrough corresponding to the three switching elastic sheets 644. The three receiving grooves 6726 are configured for receiving the corresponding switching elastic sheet 644 therein as the three switching elastic sheets 644 engaging through the base body 672. The diametrical size of the main body 642 is shorter than that of the protruding portion 674 of the pad portion 67.

Assembling process and using procedure of the key button 60 are substantially the same as that of the key button 30 of the first embodiment.

In other alternative embodiments, the main body of the switching portion can be omitted and the switching elastic sheets of the switching portion then are attached with the protruding portion of the pad portion. The switching portion can instead have at least one switching elastic sheet formed on the main body. Correspondingly, the protrusion portion of the pad portion can instead has at least one receiving groove defined therein. The pad portion can instead has at least one through aperture defined therethrough. The circuit board portion can instead has at least one second contacting point disposed thereon.

One main advantage of the present embodiments embodies that two steps of pressing the key button can significantly reduce risks of operating mistake, especially for certain people with bad eye-sight. Users may feel convenient to ascertain whether their input information at the first is what they want or not. If not, they can easily cancel the original input information by simply releasing the pressed key button.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A key button, comprising:

a key portion;

a supporting portion having a first through hole defined therethrough;

a switching portion comprising at least one switching elastic sheet;

a pad portion comprising a base body and a protruding portion, the protruding portion formed on the base body, the base body having at least one through aperture defined therethrough, the protruding portion having at least one receiving groove defined through a sidewall thereof, the at least one receiving groove communicating with the through aperture, the at least one switching elastic sheet received in the respective receiving groove and engaging through the at least one through aperture; and a circuit board portion comprising a first contacting point, a contacting sheet, and at least one second contacting point, the pad portion located between the supporting portion and the circuit board portion with the protruding portion configured for engaging through the first through hole of the supporting portion to attach with the key portion;

wherein, as the key portion is pressed towards the circuit board portion, the switching portion moves along with the pad portion so as to firstly electronically connect the contacting sheet with the at least one second contacting point via the at least one switching elastic sheet and secondly further electronically connect the first contacting point with the contacting sheet via the pad portion.

2. The key button as claimed in claim 1, wherein the switching portion is attached with the protruding portion.

3. The key button as claimed in claim 1, wherein the switching portion further comprises a main body, the at least one switching elastic sheet formed on the main body.

4. The key button as claimed in claim 1, wherein the at least one switching elastic sheet comprises a curve portion and a straight portion, the curve portion engaging through one respective through aperture, and the straight portion received in the respective receiving groove.

5. The key button as claimed in claim 4, wherein the base body of the pad portion further has an accommodating groove defined therein, the main body of the switching portion being accommodated in the accommodating groove, the main body having a second through hole defined therethrough, and the at least one straight portion extending through the second through hole.

6. The key button as claimed in claim 4, wherein the at least one switching elastic sheet is three switching elastic sheets, the three switching elastic sheets are arranged evenly on a main body, the at least one receiving groove is three receiving grooves corresponding to the three switching elastic sheets, and the at least one through aperture is three through apertures corresponding to the three switching elastic sheets.

7. The key button as claimed in claim 4, wherein a main body of the switching portion is located between the protruding portion and the key portion and disposed on the protruding portion, and the main body being attached with the key portion.

8. The key button as claimed in claim 7, wherein the at least one switching elastic sheet is three switching elastic sheets, the three switching elastic sheets are arranged evenly on the main body, the at least one receiving groove is three receiving grooves corresponding to the three switching elastic sheets, and the at least one through aperture is three through apertures corresponding to the three switching elastic sheets.

9. The key button as claimed in claim 1, wherein the at least one second contacting point is arranged around the contacting sheet and the first contacting point, the first contacting point being located within a space enclosed by the contacting sheet and the circuit board.

10. The key button as claimed in claim 9, wherein the circuit board further has at least one welding pad disposed thereon, the contacting sheet is attached with the circuit board via soldering with the at least one welding pad.

11. The key button as claimed in claim 1, wherein the at least one second contacting point is three second contacting points, the three second contacting points being arranged evenly on the circuit board.

12. A keypad assembly for a portable electronic device, comprising at least one key button, each of the at least one key button comprising:

a key portion;

a supporting portion having a first through hole defined therethrough;

a switching portion comprising at least one switching elastic sheet;

a pad portion comprising a base body and a protruding portion, the protruding portion formed on the base body, the base body having at least one through aperture defined therethrough, the protruding portion having at least one receiving groove defined through a sidewall thereof, the at least one receiving groove communicating with the through aperture, the at least one switching elastic sheet received in the respective receiving groove and engaging through the at least one through aperture; and a circuit board portion comprising a first contacting point, a contacting sheet, and at least one second contacting point, the pad portion located between the supporting portion and the circuit board portion with the protruding portion configured for engaging through the first through hole of the supporting portion to attach with the key portion;

wherein, as the key portion is pressed towards the circuit board portion, the switching portion moves along with the pad portion so as to firstly electronically connect the contacting sheet with the at least one second contacting point via the respective switching elastic sheet and secondly further electronically connect the first contacting point with the contacting sheet via the pad portion.

13. A portable electronic device, comprising:

a keypad assembly comprising at least one key button, the at least one key button comprising:

a key portion;

a supporting portion having a first through hole defined therethrough;

a switching portion comprising at least one switching elastic sheet;

a pad portion comprising a base body and a protruding portion, the protruding portion formed on the base body, the base body having at least one through aperture defined therethrough, the protruding portion having at least one receiving groove defined through a sidewall thereof, the at least one receiving groove communicating with the through aperture, the at least one switching elastic sheet received in the respective receiving groove and engaging through the at least one through aperture; and a circuit board portion comprising a first contacting point, a contacting sheet, and at least one second contacting point, the pad portion located between the supporting portion and the circuit board portion with the protruding portion configured for engaging through the first through hole of the supporting portion to attach with the key portion;

wherein, as the key portion is pressed towards the circuit board portion, the switching portion moves along with the pad portion so as to firstly electronically connect the contacting sheet with the at least one second contacting point via the respective switching elastic sheet and secondly further electronically connect the first contacting point with the contacting sheet via the pad portion.

* * * * *